US005167098A

United States Patent [19]

Blackwelder

[11] Patent Number: 5,167,098

[45] Date of Patent: Dec. 1, 1992

[54] FIRE RESISTANT MODULAR BUILDING

[75] Inventor: Paul B. Blackwelder, Akron, Ohio

[73] Assignee: The Will-Burt Company, Orrville, Ohio

[21] Appl. No.: 658,957

[22] Filed: Feb. 22, 1991

[51] Int. Cl.[5] ..... E04B 7/02

[52] U.S. Cl. ..... 52/90; 52/93; 52/263; 52/272

[58] Field of Search ..... 52/90–93, 52/168, 612, 263, 79.1, 249, 406, 407, 408, 409, 410, 785, 272, 276, 278

[56] References Cited

U.S. PATENT DOCUMENTS

| | | | |
|---|---|---|---|
| 2,074,442 | 2/1933 | Venzie | 52/408 |
| 2,438,428 | 3/1948 | Birdsall | 52/481 |
| 2,806,811 | 9/1957 | Hazmburg | 52/408 |
| 3,127,960 | 4/1964 | Smith et al. | 52/762 X |
| 3,304,676 | 2/1967 | Sallie et al. | 52/276 |
| 3,570,199 | 3/1971 | Gartner | 52/168 |
| 3,881,292 | 5/1975 | Porter | 52/276 X |
| 3,906,694 | 9/1975 | Schubach | 52/471 |
| 3,959,943 | 6/1976 | Shea et al. | 52/618 |
| 4,028,854 | 6/1977 | Diggs | 52/93 |
| 4,151,693 | 5/1979 | Harvey | 52/405 |
| 4,183,186 | 1/1980 | Haeussler | 52/410 |
| 4,574,454 | 3/1986 | Dyson | 29/434 |
| 4,578,909 | 4/1986 | Henley et al. | 52/92 X |
| 4,646,486 | 3/1987 | Hauff | 52/1 |
| 4,681,706 | 7/1987 | Mallory et al. | 252/633 |
| 4,698,948 | 10/1987 | Yamashita et al. | 52/612 X |
| 4,736,566 | 4/1988 | Krotsch | 52/795 |
| 4,784,802 | 11/1988 | Mallory et al. | 252/633 |
| 4,805,390 | 2/1989 | Majkrzak | 56/300 |
| 4,817,355 | 4/1989 | Tilsley et al. | 52/407 |
| 4,858,398 | 8/1989 | Ricchini | 52/90 |
| 4,863,638 | 9/1989 | Harper, III | 252/633 |
| 4,875,805 | 10/1989 | Gross | 405/128 |
| 4,890,764 | 1/1990 | Rossini | 220/460 |
| 4,891,923 | 1/1990 | Ericsson et al. | 52/280 |
| 4,897,976 | 2/1990 | Williams et al. | 52/281 |
| 4,906,408 | 3/1990 | Bouniol | 252/628 |

OTHER PUBLICATIONS

Fire Resistance Directory, Jan. 1988.

*Primary Examiner*—David A. Scherbel
*Assistant Examiner*—Kien Nguyen
*Attorney, Agent, or Firm*—Body, Vickers & Daniels

[57] ABSTRACT

A fire resistant modular building adapted to house flammable and/or toxic materials is prefabricated of a box-like structure with exterior walls and a roof and partitions of stacked sheets of gypsum board with a skin of sheet metal secured thereto to define the interior walls and ceiling of the building.

34 Claims, 7 Drawing Sheets

190
186
184
182
188
22
129
188
54
42
30
186
184
22
38
62
172
182
170
40
142
60
58
190
56
156
198
200
196
76
96
194
192
78
46
150
86
188
190
186
104
46
70
82
106
108
74
38
20
184
182
22
129
100
90
14
114
112
110
72
68

FIRE RESISTANT MODULAR BUILDING

This invention relates generally to modular buildings and more particularly to improvements in modular buildings which are adapted to house flammable and/or toxic materials.

The invention is particularly applicable to a modular building and construction, whereby an improved fire resistant modular building is provided and will be described with particular reference thereto. However, the invention may have broader applications and could be used in theory for other fire resistant storage or containment structures for the storage of flammable and/or toxic materials.

BACKGROUND OF THE INVENTION

The amount of hazardous waste has significantly increased with the growth of chemical industries and the use of their products. The increased toxicity and/or flammability of some of these wastes has also risen. Recognition of the hazardous nature of these materials has lead to the imposition of regulations on their storage and use.

The implementation of some of these safety regulations requires the construction of a specialized, expensive facility for storing toxic and/or flammable materials. These facilities often use masonry construction or are laboriously assembled out of very basic building elements. Once constructed they cannot be relocated. Also, with conventionally built structures it is difficult to inspect and determine that the building would ultimately meet the code standards as regards to fire resistance, secondary containment and structural strength. There is now an industry supplying factory built modular buildings with standard approved designs which conform to all applicable codes. These are shipped essentially complete to the end users facility, freeing the end user from reinventing and obtaining approval for each new facility.

The Factory Mutual Research Corporation, a nationally recognized risk evaluation and prevention company, has now adapted and enforces a generally accepted standard: "Approval Standard for Storage Buildings for Flammable and Combustible Liquids, Class Number 6049." This standard first specifies certain performance standards for the structure. These are:

- Resist 90 MPH wind (Commercial requirements have de facto pushed this to 110 MPH).
- Resist 250 pounds per square foot floor load.
- Resist 40 pounds per square foot snow load.
- Provide secondary containment equal to 25% of the liquid capacity of the building.
- Resist 100 pounds per square foot internal explosion (for explosion resistant models only). Also provide for explosion venting.

It also recognizes and classifies buildings according to varying levels of fire resistance. These may vary from none to 4 hours as established by test performed in accordance to "ANSI/NFPA 251, Fire Tests of Building Construction and Materials:, promulgated by the National Fire Protection Association.

The assignee of the present invention manufactured and sold a modular building including the prefabricated wall columns, roof and exterior panels similarly constructed to those incorporated in the present invention. These early buildings lacked explosion resistance and fire resistance, which severely limited their application.

Factory Mutual would not certify them as appropriate for the storage of Class 1A, or the dispensing of Class 1B, liquids. They could be used for the storage of less flammable liquids, but only if the building were located more than 50 feet from the user's main facility. The present invention addresses these deficiencies, and it is now recognized by Factory Mutual to be explosion resistant, to have a fire resistant wall design at the 2 hour level and to have a fire resistant roof design at the 2 hour level.

Because the original way in which the assignee achieved its fire resistance rating for its wall and for its roof is a significant part of the invention, a brief description of the testing procedure required will now be made. The governing document is ANSI/NFPA 251 or the essentially identical ASTM E119..For the walls, a typical sample the wall design is subjected on one side to a flame with a carefully defined time/temperature curve. Thermocouples on the unexposed side monitor the temperature rise there. After a predetermined time (in this invention, 2 hours) the flame is removed and the wall sample is subjected a strong hose stream to simulate the activities of fire fighters. Passing of the test requires that the temperature rise on the unexposed side during the (2 hour) test be below certain limits. Further, the hose stream cannot punch through the wall sample. If, as is the case with this invention, the wall design is asymmetrical then the test must be repeated with a new sample from the other side. The test for the roof is similar except for these two points: (1) the sample is not subject to a hose stream, and (2) the sample is only tested with flame on the bottom side.

There is a distinction made in fire rated designs between "load bearing" and "non-load bearing" wall designs. Load bearing walls are like the 1st of 2 floors, and bear significant axial loads. These must be axially loaded during the fire test. The present invention uses non-load bearing walls which only need to support themselves and fairly minor roof loads. These were not axially loaded during their test.

The present invention applies in an original way (to be described presently) a common mechanism for rendering a structure fire resistant. That is: to incorporate into the structure significant amounts of gypsum board. Gypsum board contains large amounts of water. In a model of the type to be illustrated in the present application there is about 3000 pounds of water locked up in the gypsum board. As the heat is applied, all the water is progressively turned to steam. That absorbs a large amount of energy, and as the steam dissipates the thermal energy is dissipated with it. It takes over two hours in the present invention to boil all the water away. As long as there is water left, the temperature of the unexposed wall will not rise above 100 degrees centigrade. After the water has been driven from the gypsum board, the board becomes very crumbly and cannot by itself resist the force of the fire hose stream.

SUMMARY OF THE INVENTION

The present invention is generally directed to a fire resistant modular building incorporating platform, roof and wall designs which integrate the structural requirements to resist wind, snow and internal explosion loads and to provide secondary containment with the thermal/structural requirements to obtain a (2 hour) fire rating. The building elements are of such a size and configuration that they may be made in a sheet metal fabrication shop and painted on a normal paint line.

Other features make the building easy to assemble consistently and reliably. The result is a building which can be pre-certified to meet all relevant codes for a fire resistant, explosion rated, hazardous materials storage building.

In accordance with the invention, a fire resistant modular building can be constructed of a box-like structure with these basic elements: a platform, corner wall columns, a roof frame, wall panels and roof panels. The thermal elements, which in conjunction with the structure of the building yield the fire resistance, are three layers of gypsum board applied to the interior of the structure and an inner "skin" of 20 gauge steel. The structural elements of the building are connected to each other with solid core rivets because the rivets provide a consistent, predetermined connecting force as long as the rivets are properly installed.

In accordance with the invention, the fire resistant modular building rests upon a platform. The platform includes a liquid tight sump disposed below the floor of the building to provide secondary containment for any material stored in the material. The platform is designed to withstand the required floor load, to form anchor points so that the walls and corners can sustain their loads and to provide exterior anchor points so that he building can be attached to the ground as required.

In accordance with the invention the structure contains corner wall columns. These are attached at the bottom to the platform with ¼ inch stainless steel bolts, to the roof frame with a multitude of solid core rivets and to wall panels alone both axial edges. They are designed to be made of extra heavy material and to have a very rigid joint at the roof frame to resist the racking of the structure during the 110 MPH wind where a large door opening removes the stiffness normally granted by the wall panels.

In accordance with the invention the structure contains a roof frame consisting of a multiple of beams arrayed parallel to each other and two headers disposed perpendicular to the beams and attached to the beam ends. The roof structure is connected to the corner columns, wall panels and roof panels with solid core structural rivets in sufficient size and quantity to resist all required loads. The roof structure is designed to resist the 40 psf snow loads and the 100 psf internal explosion loads as required. It also forms the top anchor point for the wall panels.

In accordance with the invention there are a plurality of wall panels. These are manufactured of sheet steel and feature a diaphragm with integral beams about their circumference. They are attached with industrial rivets to the roof frame, adjacent wall panels or corner columns and to the platform. They are designed to withstand the wind and internal explosion loads, to support axially the relatively minor roof loads and to provide stiffness to the structure to resist racking during wind loads.

In accordance with the invention the final structural element is the roof panels. These are attached to the roof frame with solid core rivets. These are basically a diaphragm to shed rain, but they are also shear panels to resist racking in the horizontal plane.

In accordance with the invention the first thermal element is three layers of ⅝ inch thick type X fire rated gypsum board attached to the inner surface of the structure. The seams of the three layers of the gypsum board are staggered so there is nowhere a clear gap between the boards. Each sheet is individually attached to the structure (that is to say one does not place three sheets against the wall structure and hold them all with one long fastener) with self drilling screws. This has the result that the weakening or collapse of one piece of gypsum board does not compromise the installation of adjacent or less exposed sheets. The gypsum board resist fire by virtue of the water held within it as has been previously expounded.

In accordance with the invention the second thermal element is a 20 gauge steel inner "skin" applied to the inner surface of the gypsum board. It protects the gypsum board from physical and chemical harm. It typically has a chemically resistant epoxy paint. During fire exposure it reflects some heat and helps hold the gypsum board in place by virtue of its dense attachment (approximately every 12 inches) through the gypsum board to the structure with self drilling screws. It also forms the first, though not the definitive, line of resistance to the hose stream.

In accordance with the invention there are several features which effectively integrate the thermal and structural elements of the modular fire resistant building. The structure not only resists various wind, snow and explosion loads but also provides the framework upon which the gypsum board is hung. The structure was designed so that the complete perimeter of any expanse of gypsum board (a wall or a roof) is continuously supported. Finally, the exterior wall panels form the primary barrier to the fire resistance test hose stream. It is not three layers of gypsum board which have been certified as possessing a 2 hour fire resistance rating for a non-load bearing wall, it is three layers of gypsum board with a 20 gauge steel skin on one side and steel wall panels on the other which has been certified. It is not three layers of gypsum board which have been certified as possessing a 2 hour fire resistance rating for a roof, it is three layers of gypsum board with a 20 gauge steel skin on one side and a roof frame providing continuous circumferential support and a plurality of beams across the interior along with roof panels which has been certified as possessing a 2 hour fire resistance rating.

It is thus a principal object of the present invention to provide a fire resistant modular building and method of constructing the building wherein the structural elements and the thermal elements complement each other without the problems, deficiencies and duplication of the prior art modular buildings and methods of constructing the buildings.

It is another object of the invention to provide a prefabricated, fire resistant modular building which is automatically certified for the storage of flammable and/or toxic materials when assembled according to specifications prior to being affixed in place at the construction site.

A further object is to make essentially all of the pieces of such a size and configuration that they can be fabricated in a typical sheet metal fabrication facility and painted on a paint line.

A further object of the invention is to provide a fire resistant modular building and method of constructing the building wherein all structural elements are secured to each other by industrial solid core rivets so that the specified design securing force elements to each other can be guaranteed.

A yet further object of the present invention is to provide a fire resistant modular building and method of constructing the building wherein the building, being constructed of prefabricated components, can be assembled relatively quickly and easily without the need and expense of skilled builders.

A still further object of the present invention is to provide a method of embodying fire resistance in a relatively simple roof design (both frame and panel) which is more appropriate for the relatively small and simple buildings of the sort disclosed herein.

A final specific object of the present invention is to provide a method of embodying fire resistance in a wall section where the needs for building structural strength, protection against the environment, fire resistance, resistance to fire hose spray and a structure on which to hang gypsum board is achieved with three sheets of gypsum board, a wall panel and an inner skin. This scheme differs from prior art that relies typically on four sheets of gypsum board, a stick built interior structure and inner and outer skins.

By combining the features of the present invention, a building that is appropriate for the storage of toxic and flammable materials which require fire resistance and explosion resistance is provided. It integrates all relevant structural and thermal elements so that all pieces contribute fully by design to the specific requirements of modular fire resistant, hazardous material storage buildings as defined by Factory Mutual Research Corporation. It does so in an efficient and reliable fashion. Consequently, the present invention is a substantial improvement in modular, fire resistant storage buildings over prior art which utilize structural and fire resistance designs appropriate from conventional buildings addressing different needs.

These and other advantages of the present invention will become apparent from the following description taken in continuation with the accompanying drawings which are described below.

BRIEF DESCRIPTION OF THE DRAWINGS

The invention may take physical form in certain parts and arrangements of parts, preferred embodiments of which will be described in detail and illustrated in the accompanying drawings which form a part hereof and wherein.

DETAILED DESCRIPTION OF THE INVENTION

Figure 1:
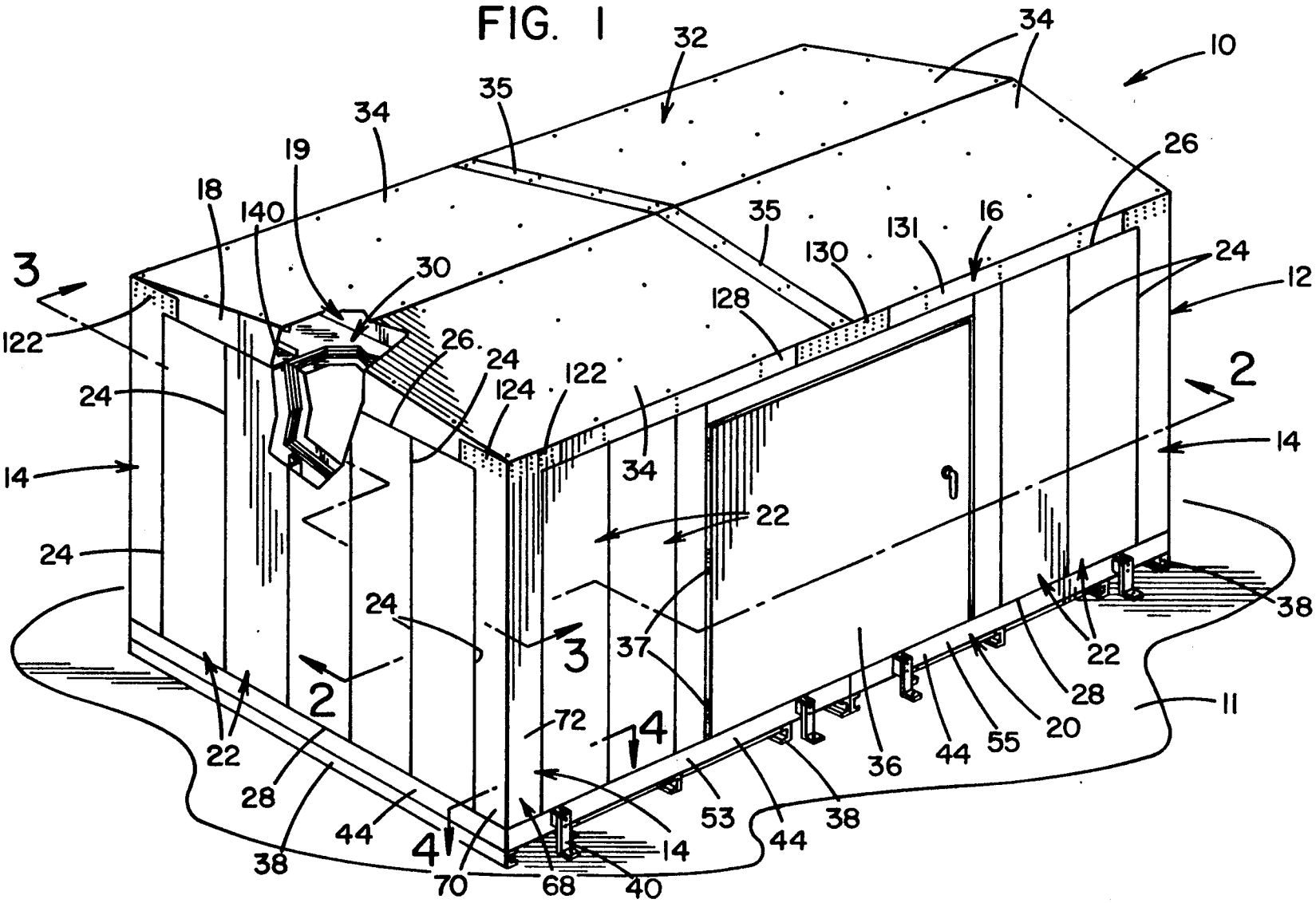
FIG. 1 is a perspective, front elevation view of a fire resistant modular building.

Referring now to the drawings wherein the showings are for the purpose of illustrating the preferred embodiment of the invention only and not for the purpose of limiting same, FIG. 1 illustrates a fire resistant modular building 10 suitable for storing flammable and/or toxic materials. The building generally includes a generally rectangular box-like frame 12 including upright corner wall columns 14, roof beams 16, pitch panels 18, and a support platform 20. Further, the structure includes exterior, non-load bearing panels 22 which are each interconnected with and secured to adjacent exterior panels along vertically extending edges 24. The panels 22 are further connected at oppositely disposed upper and lower ends 26 and 28 to an adjacently disposed roof beam 16 or pitch panel 18 at upper end 26 and to a support platform 20 at the lower end 28. Further, the vertically extending edges 24 disposed adjacent the upright columns 14 are connected and secured thereto. Also, as illustrated through a cut away section of FIG. 1, interior elements or partitions 30 are interconnected and secured to the structure; in this particular cut away to the exterior panels 22 and to the end pitch panel 18.

The fire resistant modular building 10 also includes roof panels 32 which are illustrated as being generally constructed of four sections 34 of rectangular, 16 gauge sheets of generally rectangular steel. The sections are supported on and attached to exterior facing surfaces on the outer pitch panels 18 and inner pitch panels 19 and roof beams 16. The inner pitch panels are substantially equally spaced across the length of the building and are attached at opposite ends to roof beams 16. In addition there are two peak panels 35. Interior partitions 30 are secured to interior facing surfaces of the inner and outer pitch panels and the roof beams to form the interior ceiling.

A side of the building includes a door 36 preferably attached by hinges 38. Preferably only one door per building is provided, but is is within the scope of the invention to add as many doors as desired. Any reduction in building rigidity due to door opening(s) has been compensated for in the design of other elements, particularly the corner columns 14.

The platform 20 of the building 10 is here shown constructed in two sections 53 and 55. The invention allows for the use of one, two or more substantially identical sections depending on the overall width or length of the building desired. The two sections of platform 20 are raised from the ground by a plurality of elongated structural members 38 which are in spaced relationship with each other across the length of the building and extend the width thereof. The structural members 38 have a U-shaped cross sectional configuration. However, structural members of other configurations can be used. Preferably, the structural members are attached to the platform 20 by conventional techniques such as welding. Building 10 is secured to the site, typically a concrete slab 11, with L-shaped securing elements 40 attached to the support platform 20. Elements 40 can be connected to the ground by conventional techniques such as with a threaded stud embedded into the slab 11 and secured within securing elements 40.

Figure 2:
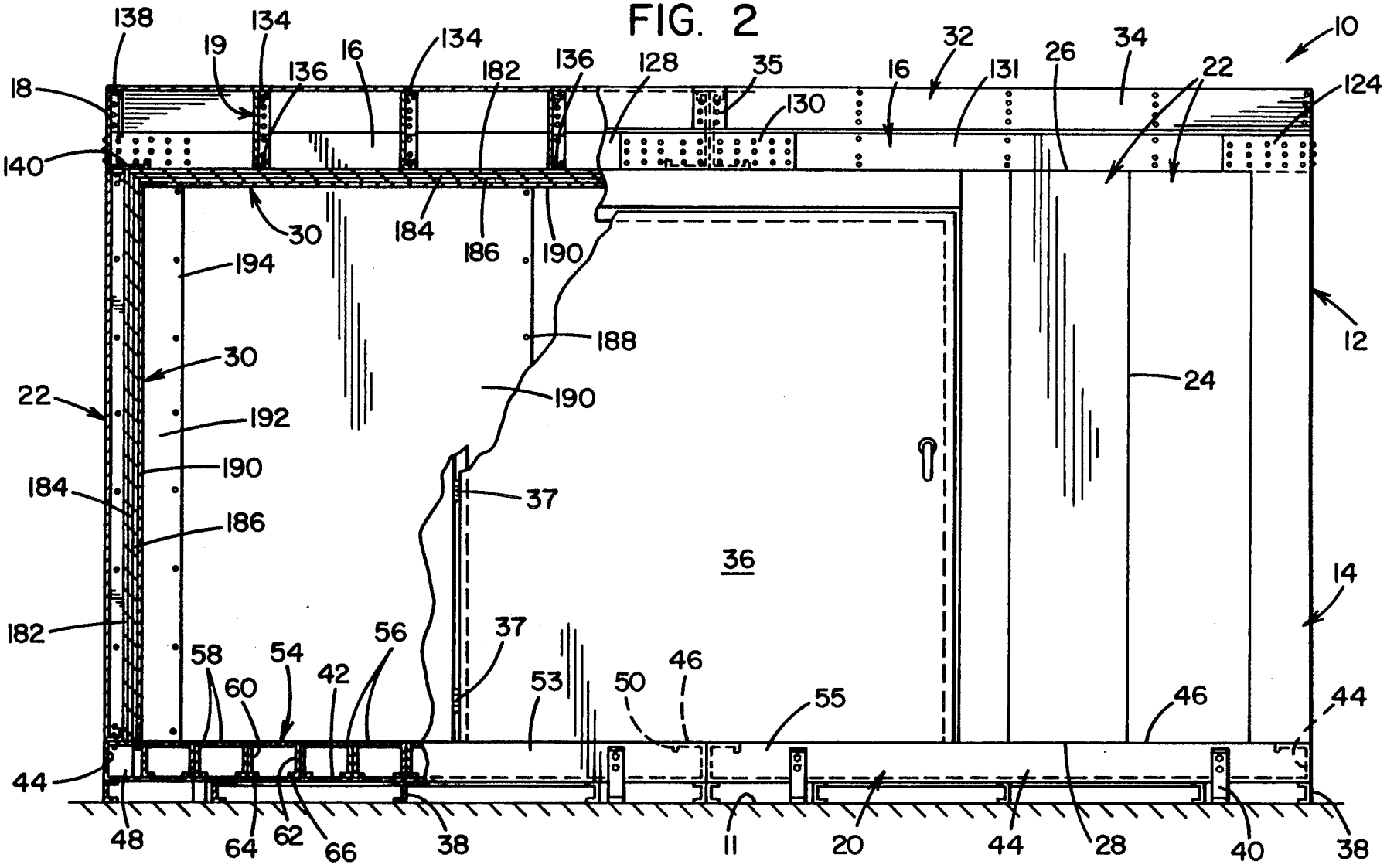
FIG. 2 is a view through line 2—2 of FIG. 1 partially cut away to illustrate the internal structure of the building.
Figure 5:
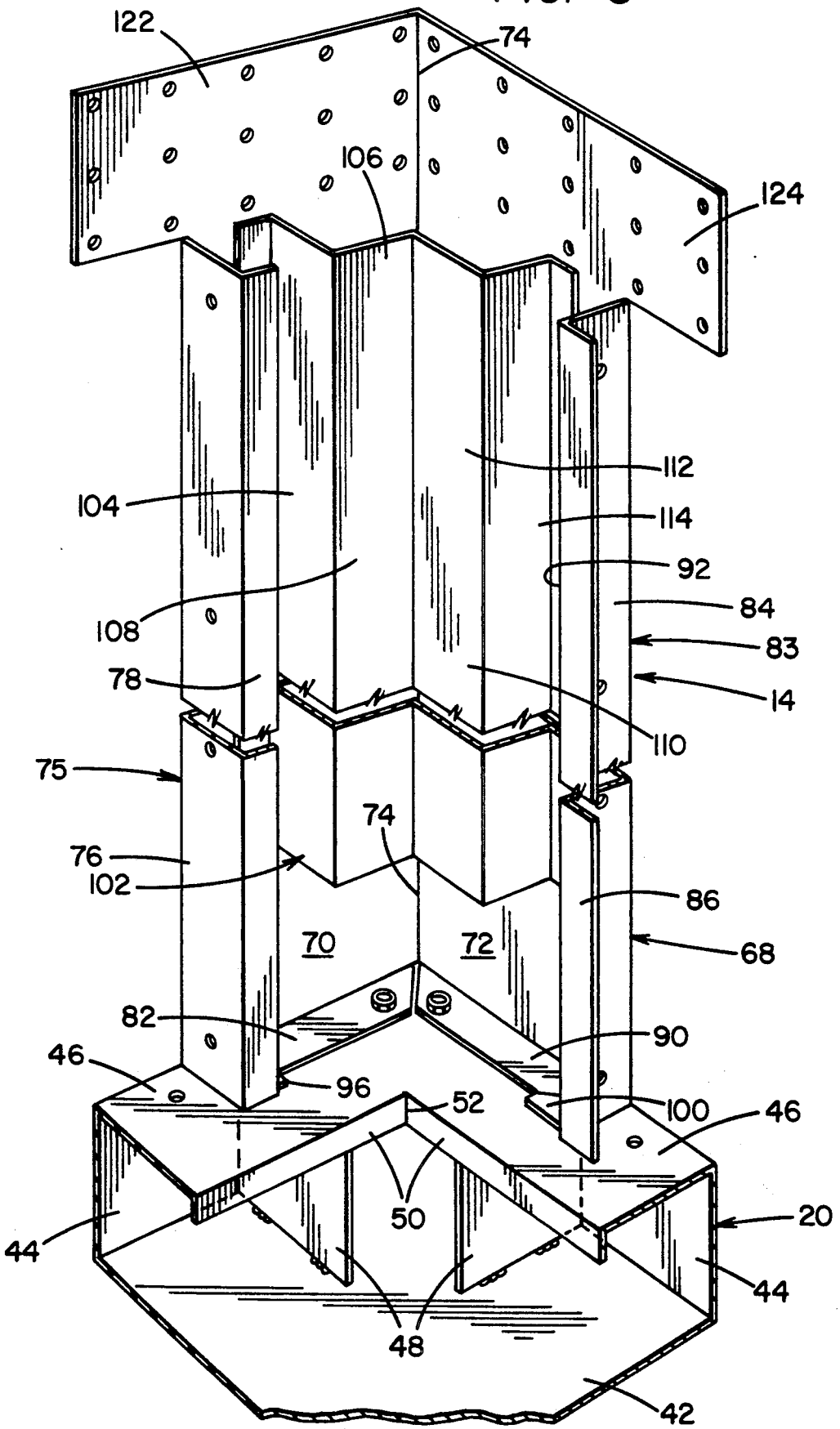
FIG. 5 is a perspective view illustrating a corner column and its attachment to the support platform of the building.

Referring now to FIGS. 1 through 7, the support platform 20 forms the base for the building 10. The support platform included two steel sections having flat bottom surfaces 42 which, in conjunction with upstanding side walls 44, form a rectangular enclosure or sump to collect any liquid which might leak from containers stored in the building. The free ends 46 of the upper side walls, as illustrated in FIG. 5, are folded at right angles thereto to overlie the bottom surface 42 in a plane substantially parallel thereto. The free ends 46 provide a load bearing surface which supports the walls and roof of building 10. To ensure the rigidity of the free ends 46, rectangular support plates 48, as best seen in FIG. 5, are disposed between the inner surface of the free ends 46 and the inner surface of the interior facing surface 42 of platform 20 and attached thereto by conventional technique, such as welding. Also the edges 50 of the free ends 46 are folded at right angles thereto to overlie the upstanding side wall 44. These free ends which intersect at corner 52 further increase the overall rigidity of support platform 20. To further increase the strength of the platform 20 and to enable it to be more easily moved for assembly, the platform can comprise two substantially identical rectangular enclosures or sections 53 and 55 which are placed abutting each, as seen in FIG. 2, so that the upstanding side walls extending along the front (containing the door) and rear of the building are substantially parallel to each other. Also the upstanding side walls 44 at either end of the building are substantially parallel to each other. The abutting enclosures 53 and 55 are bolted to each other or secured with conventional techniques such as with solid rivets or welding. Although not illustrated, there is typically a splice channel which abuts against and is secured, typically by bolting, to both upstanding side walls extending along the front and rear of the building to impart major strength to the connection of the two adjacent enclosures.

Figures 4, 9:
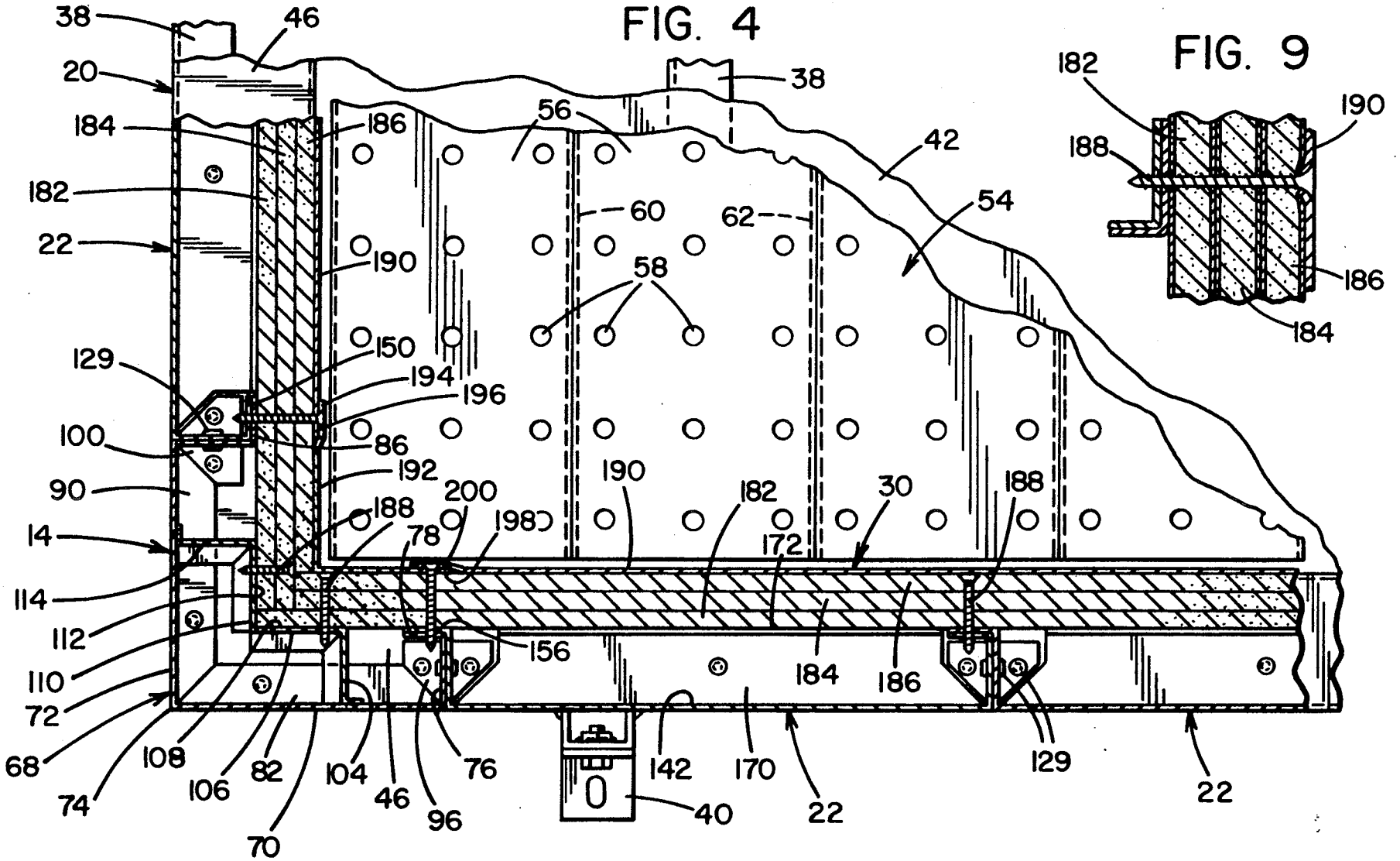
FIG. 4 is a view through line 4—4 of FIG. 1 illustrating the assembly of an interior partition to the structure and the exterior panels.
FIG. 9 is a sectional view illustrating the inner partition and its attachment to an integral connection joint between adjacent exterior panels.

A floor 54, as seen in FIGS. 2 and 4, is upraised from and supported by the bottom surface 42 of support platform 20. The floor includes floor plates 56 having a plurality of spaced holes 58 therethrough to provide for the drainage of any fluids in the building, such as leakage from the stored materials, into the sump formed by the support platform 20. The floor plates 56 are preferably elongated structural members having two legs 60 and 62 folded at right angles thereto t overlie each other in parallel planes and to support the upper surface of the floor plates above the surface 42 of the platform. Each of the legs 60 and 62 include feet 64 and 66 folded at right angles thereto to increase the rigidity of the legs and to increase the area of the support surface contacting surface 42 to further ensure a stable floor 54 upon which containers of materials can be disposed.

Figure 3:
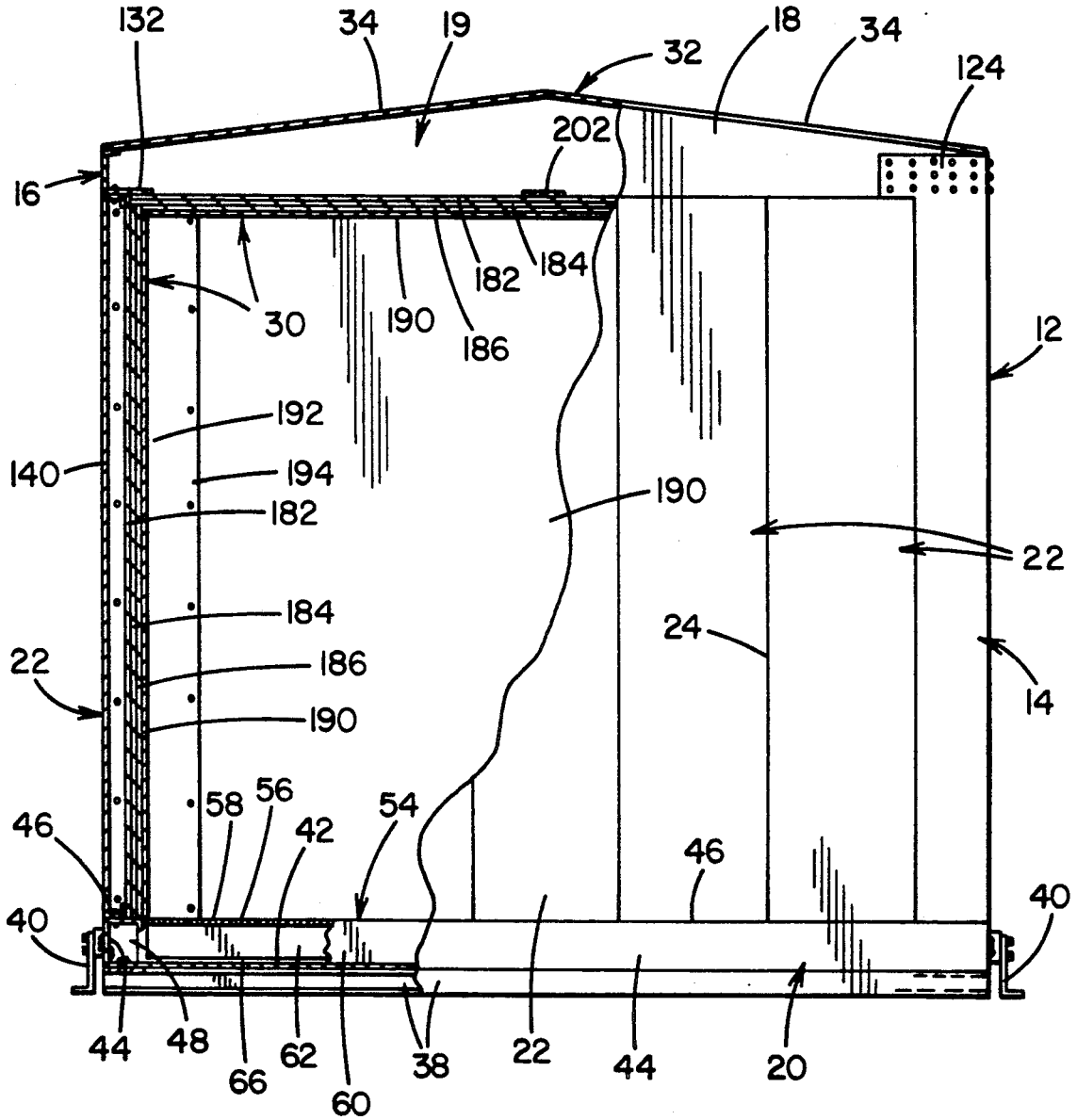
FIG. 3 is a view through line 3—3 of FIG. 1, partially cut away to illustrate the internal structure of the building.

At each corner of building 10 is an upright corner wall column 14, generally illustrated in FIGS. 1-3 and in particular detail in FIGS. 4 and 5. The corner wall columns are essential structural components of the building because they are load bearing and also are especially designed to provide rigidity for the building. Each of the corner columns include an elongated corner section 68 having a right angle cross sectional configuration. Corner section 68 is formed of two elongated corner portions 70 and 72 folded at right angles to each other along a fold line 74. An interconnection member 75 includes free end section 76 of the corner portion 70 being folded at a right angle to corner portion 70 so as to overlie the corner portion 72. A terminal end 78, folded at a right angle to end section 76, overlies the corner portion 70. At the bottom end of portion 70, end flap 82 is folded over at right angles and outward from portion 70 towards terminal end 78. An interconnection member 83 includes a free end section 84 of corner portion 72 being folded at a right angle thereto so as to overlie corner portion 70. A terminal end 86, folded at a right angle to end section 84, extends in a direction away from corner portion 70. At the bottom end of portion 72, flap 90 is folded over at right angles and extends outwardly from portion 72 towards the intersection edge 92 of end section 84 and terminal end 86. The bottom ends 96 and 100 of the tree end sections 76 and 84, respectively and the end flaps 82 and 90 are cut to form a flat support surface including end flaps 82, 92 and outer ends 96 and 100.

To support and attach the interior elements 30, an interior, elongated support member 102 is secured to the corner portions 70 and 72. The support member 102 has a generally W-shaped cross sectional configuration. A first leg portion 104 is attached to and projects outward at a right angle from corner portion 70. An elongated first support element 106 is folded at a right angle to leg 104. The outer surface 108 of element 106 is disposed in a plane which includes the interior facing surface of terminal end 78. This enables an end of an internal element 30 to be firmly supported against the load bearing column 14 as discussed hereinafter. An elongated second support element 110 is folded at a right angle to support element 106 and overlies corner portion 72. The outer surface 112 of element 110 is disposed in a plane which includes the interior facing surface of terminal end 86 to support an element 30 as previously discussed. The second leg 114 is attached to and projects inward at a right angle to both support element 110 and corner portion 72. The support member is attached to column 14 by any conventional technique such as welding.

The column 14 also includes integrally, attached portions 122 and 124. These portions extend upward from corner portions 70 and 72, respectively, and are disposed at right angles about fold line 74. Additionally, portion 122 extends outward from the face of section 76, and portion 124 extends outward from the face of section 84. Portions 122 and 124 include a plurality of through holes to secure the roof beams 16 and the outer pitch panels 18 to the columns 14.

As best seen in FIG. 5, the lower ends of the columns 14 are disposed on the upper surface of the free ends 46 of the side walls 44 and securely attached thereto by conventional techniques such as ¼ inch stainless steel bolts.

The structure 12 of building 10, besides the corner columns 14 and the support platform 20, includes the roof beams 16 which extend between the columns 14 along both the front and rear of the building. As illustrated in FIG. 2, each roof beam is constructed of two members 128 and 131 abutted together and secured with a plate 130 attached to both the outer ends of the beam members and secured to the rectangular portions 122 and 124 of the corner columns 14. The roof beams include legs 132, see FIG. 3, which are substantially parallel to the surface 42 of the platform and provide a support for the ends of the elements 30. The structure 12 also includes outer pitch panels 18 which extend between the columns 14 along the opposite ends of the building. These outer pitch panels are secured to the rectangular potions 122 and 124 of corner columns 14.

A roof panel, generally designated as 32, includes the inner and outer pitch panels, the roof beams, the roof sections 34 and the ceiling elements 30. The spaced inner pitch panels 19 are disposed so as to span across the top of the building and are connected to the roof beams 16 by solid core rivets so as to project substantially upward at right angles to the surface 42 of platform 20. The inner pitch panels have end sections 134 and 136 at opposite ends folded over and disposed at right angles to the pitch panels. Roof sections 34 are supported on and attached to end sections 134. The sections 136, as best seen in FIG. 2, provide a support surface for the ceiling elements 30 forming the interior ceiling. Also, the end pitch panels 18 have end sections 138 and 140 at opposite ends folded over and disposed at right angles to the pitch panels. Roof sections 34 are supported on and attached to end sections 138. Section 140, as best seen in FIG. 2, is in the same plane as section 136 of the inner pitch panels and leg 132 of the roof beam, and provides a support surface for the partitions 30 forming the interior ceiling.

Figure 6:
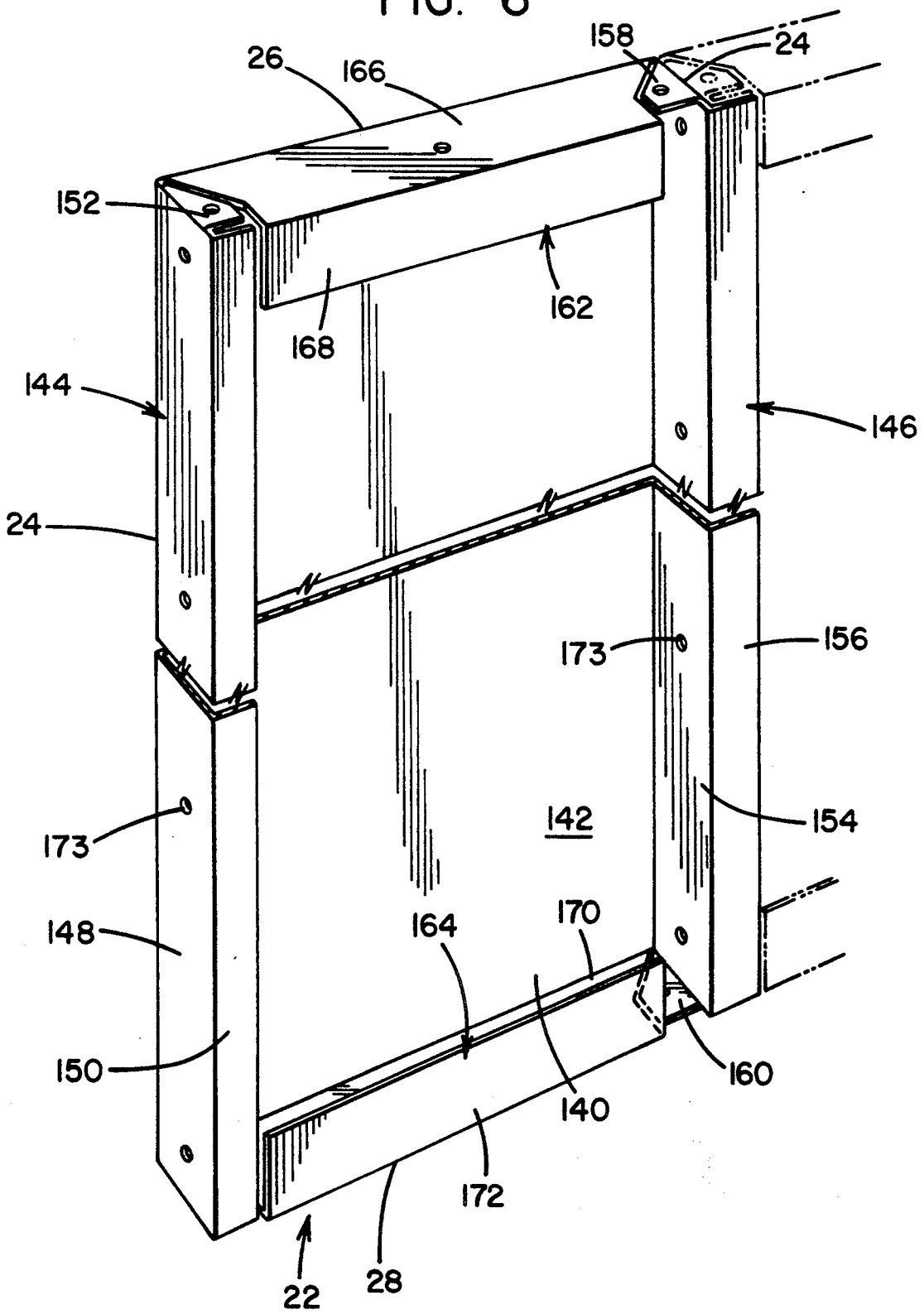
FIG. 6 is a perspective view of an exterior panel and the interconnection with an adjacent exterior panel shown by dotted lines.

The exterior walls of building 10 are primarily constructed of exterior wall panels 22 as seen in FIGURES 1–4, 6, 7, 8A–8E and 9. Referring specifically to FIG. 6, the panels 22 include a rectangular section 140 having an interior surface 142. Along the sides of each panel are interconnection members 144 and 146 extending between the upper and lower ends 26 and 28 thereof. The interconnection member 144 includes an end element 148 folded at right angles to section 140 and extending towards the interior of the building. A free end portion 150 is folded at a right angle to end element 148 and overlies the surface 142. Flap members 152 at either end of end member 148 are folded at right angles thereto and extend toward the interconnection member 146. The interconnection member 146 includes an end element 154 folded at right angles to section 140 and extending towards the interior of the building. A free end portion 156 is folded at a right angle to end element 154 and projects outward and away from the surface 140. Flap members 158 and 160 at either end of the end member 154 are folded at right angles thereto and towards the interconnection member 144. At the upper and lower ends 26 and 28, respectively, the exterior panels include upper and lower connector members 162 and 164. The upper connector member 162 has an upper end portion 166 folded at right angles to the section 140. An upper free end 168 is folded at a right angle to the upper end portion 166 and overlies surface 142. The lower connector member 164 has a lower end portion 170 folded at a right angle to section 140. A lower free end 172 is folded at a right angle to the lower end portion 170 and overlies surface 142. The interior facing surfaces 150 and 156 of the free end portions 144 and 146 and the upper free end 168 and lower end 172 are in substantially the same plane and collectively provide a support surface for the interior elements 30 as will be discussed hereinafter.

Figure 7:
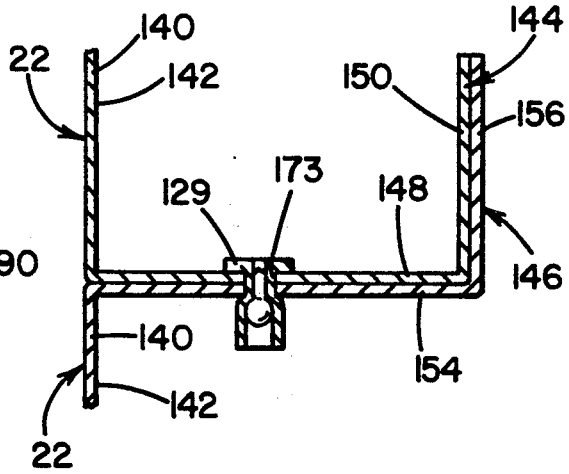
FIG. 7 is a section view through adjacent exterior panels illustrating their interconnection and securing with a solid rivet.

The exterior wall panels 22 are specifically designed for ease of assembly as prefabricated components. The interconnection members 144 are disposed against an adjacent interconnection member 146 and secured thereto with industrial rivets 129 disposed in aligned through-holes 173, as illustrated in FIG. 7. The corner columns 14 are also provided with interconnection members 75 and 83 which mate with interconnection members 146 and 144, respectively, of the exterior panels 22. Each of the exterior panels is disposed upon and secured through the lower end portions 170 to the free ends 46 disposed around the periphery of support platform 20. To prevent corrosion, the external facing surface of the exterior panels has a coating of aliphatic polyurethane.

The cooperative relationship between the non-load bearing interior elements also called partitions 30, exterior wall panels 22, and the remainder of structure 12 provide a significant aspect of the invention of building 10. The interior wall and ceiling partitions are constructed of three layers of gypsum board which are fire resistant, so that he building structure constructed of the enclosure assembly of the invention will be substantially fire resistant. In addition, metal sheets 180 are clad onto the interior facing surfaces of the non-load supporting interior partitions 30.

Referring to FIGS. 1–4, 8A–8E and 9, the details of the partitions 30 which form the interior walls and the ceiling can be better appreciated. The partitions 30 preferably include at least three stacked sheets 182, 184 and 186 of $\frac{5}{8}$ inch thick, type X, fire-rated gypsum board which provide a two hour fire rating. The sheets of gypsum board are stacked with the exterior board designated as 182, the interior board designated as 186 and the intermediate board designated as 184. The gypsum boards 182, 184 and 186 are secured to the structure 12 by self-drilling screws 188. With regard to the wall partition, as illustrated in FIGURE 4, the stacked gypsum boards are supported against the surfaces 108 and 112 of support element 106 and 110, respectively, and secured thereto by self-drilling screws 188. Also, the stacked gypsum boards are supported and secured to the interior facing surfaces of terminal ends 78 and 86 of the columns 14 and the surfaces of end portions 150 and 156 of exterior panels 22. The stacked boards are also supported against and secured to the interior facing surface of the upper and lower free ends 168 and 172 of the exterior panels 22. The boards are thereby in spaced relation to the interior facing surface 142 of wall panels 22. An important structural consideration is that the boards are overlapped, as illustrated in FIGS. 8B through 8E so that heat from a fire cannot penetrate directly through the line of intersection of adjacent boards. Although three stacked layers of gypsum board are preferred, it is within the terms of the invention to use two layers of gypsum board which provide a one and one-half hour fire rating or more than 3 layers as required.

Figure 8A:
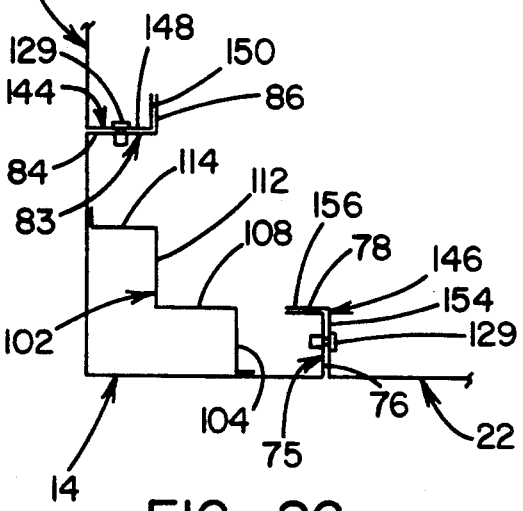
FIGS. 8A–8E illustrate a corner column attached to exterior panels in schematic form and the details of the progressive attachment and securing of the three layers of gypsum board and the interior sheet metal plate thereto.
Figure 8B:
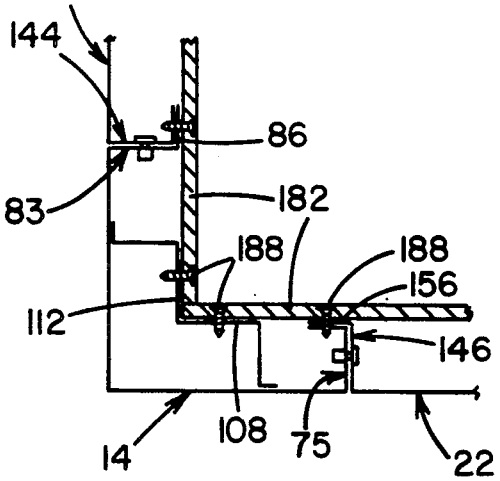
Figure 8C:
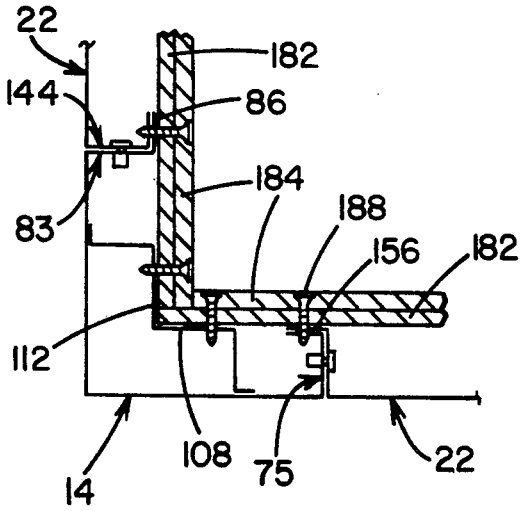
Figure 8D:
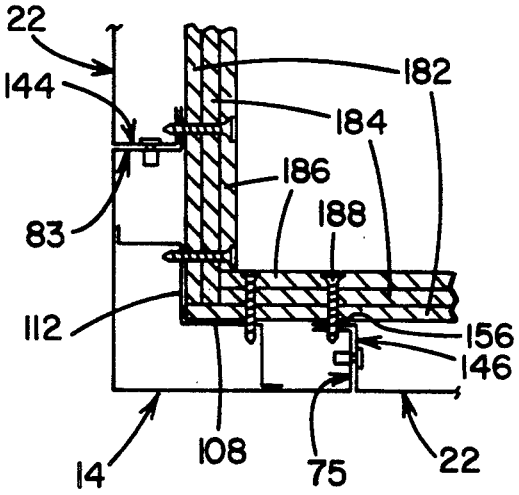
Figure 8E:
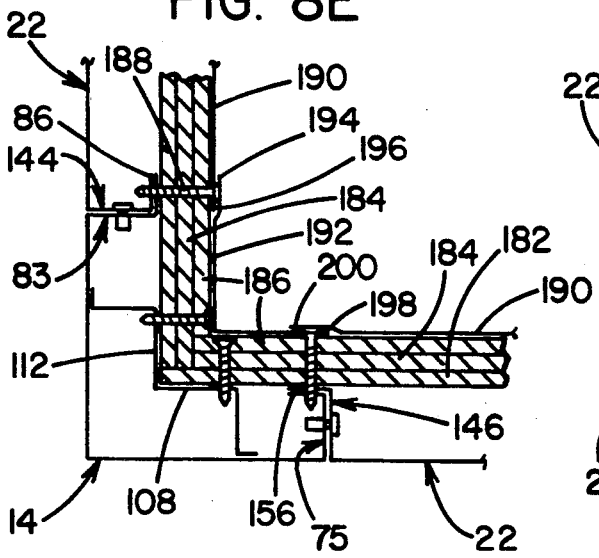

Besides the gypsum board, the elements also include sheets 190 of metal, preferably of 20 gauge steel, disposed against the interior facing surface of gypsum board 186 and secured to the structure, the corner columns and the exterior panels 22 with self-drilling screws 188 in the same manner as the gypsum boards. Any number of sheets of metal with overlapped edges can be used to provide a metal interior wall. In the corners, an L-shaped corner strip 192 of metal sheet having a length substantially the same as the exterior panels, as best seen in FIGS. 4 and 8E, has one edge 194 which overlaps an edge 196 of an adjacent metal sheet and edge 198 which is overlapped by an edge portion 200 of an adjacent metal sheet. The overlapping sections of metal sheets are secured by the self-drilling screws to the support surfaces of the exterior board 182 on the terminal ends 78 and 86. The interior facing surface of the metal sheets is coated with a chemical resistant epoxy paint to prevent corrosion from exposure to fumes from chemicals stored in the building.

The ceiling partitions of the interior elements 30 are similar to the wall partitions. The ceiling partitions, as seen in FIGS. 2 and 3, are supported against the surfaces of legs 131, end surfaces 140 and sections 136. The tie strap 202 runs between the end pitch panels and resists the loads transmitted to the end pitch panels by the exterior roof panels during a 100 pounds per square foot explosion. Only the end pitch panels are attached to the tie strap. As with the wall partitions, any desire number of metal sheets can be used to cover the ceiling, and the edges of the metal sheets are overlapped to retard the heat flow from fire onto the gypsum sheets. The roof panel construction is a significant aspect of the design because it acts as a diaphragm to sustain snow loads and to resist horizontal racking of the building.

The effectiveness of the fire resistance provided by the elements 30 is attributed to the accumulative effect of a number of factors. Steam is formed from the water contained in the hydrated plaster when the gypsum board is subjected to the heat. The conversion of the water in the gypsum board to steam absorbs a tremendous amount of energy. Also, the sheet metal interior layer retains the crumbly, dried up gypsum board. Also, the exterior wall panels 22 resist the impact of the fire hose stream. Further, the interior wall and ceiling elements 30 are non-load bearing and are not subjected to the same forces associated with the structure 12. Also, the ends of the gypsum board as well as the interior metal sheets 190 are staggered to overlie abutting points between adjacent gypsum boards to prevent a direct pathway for heat flow through the elements 30. Moreover, each sheet of gypsum board as well as the metal sheet covering is individually secured to the structure so that the destruction of one sheet does not cause the loss of any other sheet.

A general description of the construction of the modular building 10 of the present invention is now set forth. First, building site 11 is selected and preferably provided with a slab of cement. Meanwhile, at the factory, the sections 53 and 55 of the support platform 20 are positioned and secured to each other. Next the columns 14 are secured to each corner of the support platform and bolted thereto with stainless steel bolts. Roof beams 16 are attached to the upper ends of the columns so that they extend along the length of the front and back of the building. Also the outer pitch panels 18 are secured in place between the columns at either side of the building. Both the roof beams 16 and the outer pitch panels are secured with solid rivets into the portions 122 and 124 disposed at the upper ends of each of the corner columns 14. The plurality of inner pitch panels 132 are now secured in place to span between the roof beams 16. Also longitudinal tie strap 202 is attached at the center of the outer pitch panels 18 so as to span the length of the building.

Next, the exterior panels 22 are placed between the support platform and the roof beams and outer pitch panels in mated, abutting relationship with each other and the columns. Then, the panels 22 are riveted to each other, the columns, the platform, the roof beams and the outer pitch panels to form a rigid building structure. The outer structure of the building can now be completed by the attachment of the roof sections 34 to the inner and outer pitch panels as well as the roof beams 16 using solid core rivets.

The inner, non-load bearing wall and ceiling elements 30 are next secured in place. The exterior gypsum sheet 182 is first attached at the front and back side of the building using self-drilling screws as illustrated in FIGS. 2, 4 and 8B. Next the exterior gypsum sheet 182 is secured into place against the inner pitch panels. Then the two sheets 182 and 184 are individually secured in place at either end of the building. Note that the top of sheet 182 is higher than sheet 184 in FIG. 2 and forms a slot to receive the edge of sheet 182 disposed across the top of the building. The remainder of the sheets are secured into place so that their ends are staggered over underlying abutting edges between adjacent sheets of gypsum board as illustrated in FIGS. 1–4 and 7. Then the interior forming metal sheets 190 are secured into place to cover both the ceiling and inside walls of the building. A corner strip 192, as seen in FIGS. 4 and 8E, enables the metal sheets to have an overlapping connection instead of abutting at the corners. The door 36 is attached and the floor plates 54 are inserted. The building is then transported to the building site and secured to the cement slab in a conventional manner, such as bolting through structural members 40. Finally, the electrical and plumbing connections (if any) are made. It is within the terms of the inventions to construct the building using any sequence of steps as desired.

While specific gauges have been disclosed for the metal sheets used in constructing the building 10, it is within the terms of the invention to use any gauge sheets as desired.

The invention has been described with reference to a preferred embodiment and it is apparent that many modifications can be incorporated into the design and assembly of the structural components of the fire resistant modular building disclosed herein without departing from the sphere or essence of the invention. It is intended to include all such modifications and alterations insofar as they come within the scope of the present invention.

Having thus defined the invention, it is claimed:

1. A fire resistant modular building, having a front and a rear side and an interior wall and an interior ceiling, said building comprising:

a generally rectangular, box-like structure including a rectangular support platform, four corner wall columns having first and second opposite ends, each of said columns being secured at said first end to and extending upright from a corner of said support platform, substantially parallel disposed roof beams extending along said front and said rear sides of said structure and secured to said second end of said columns, parallel disposed outer pitch panels extending transversely to said roof beams along said sides of said structure and secured to said second end of said columns, a plurality of spaced, inner pitch panels having first and second ends connected to said parallel disposed roof beams and exterior wall panels secured to and supported in spanning relationship between said columns for defining a wall structure of said building, exterior roof panels secured to and supported on said outer pitch panels and said inner pitch panels in spanning relationship for sustaining loads and resisting racking in a horizontal plane, a plurality of partitions forming said interior wall and said interior ceiling of said building, said partitions comprising a plurality of wall partitions secured to and supported on said exterior wall panel in spanning relationship between said columns to define said interior walls of said building and a plurality of ceiling partitions being secured and attached to said outer pitch panels and said inner pitch panels in spanning relationship below said exterior roof panels to define said interior ceiling of said building; and each of said wall and ceiling partitions comprising, a plurality of stacked sheets of gypsum type board and a metal sheet having a plurality of outside edges, said metal sheet stacked against one of said sheets of gypsum type board, said edges of said metal sheet overlaps said edges of an adjacent said metal sheet to form an interior facing metal surface for said walls and said ceiling of said building.

2. A building as defined in claim 1 wherein said plurality of gypsum type board sheets comprise at least two stacked sheets.

3. A building as defined in claim 2 wherein said plurality of gypsum type board sheets comprise three or more stacked sheets.

4. A building as defined in claim 1 wherein said plurality of outside edges of said metal sheet includes at least a top edge and a bottom edge and each said gypsum board sheet includes a top and bottom edge, said top and bottom edge of each of said metal sheets overlap said top and bottom edges of at least one of said gypsum boards against which the metal sheets are disposed.

5. A building as defined in claim 1 further including means for securing said sheets of gypsum board and said sections of covering metal sheets to said box-like structure.

6. A building as defined in claim 5 wherein each sheet of said gypsum board and each said metal sheet are individually attached to said box-like structure.

7. A building as defined in claim 6 wherein said means for securing said sheets of gypsum board and said metal sheets comprise self-drilling screws.

8. A building as defined in claim 1 wherein each of said sheets of gypsum type board comprise ⅝ thick type X, fire rated gypsum board.

9. A building as defined in claim 1 wherein said metal sheets are constructed of 20 gauge steel.

10. A building as defined in claim 1 further including a chemical resistant coating on said interior facing metal surface.

11. A building as defined in claim 1 wherein said exterior wall panels each have exterior and interior facing surfaces, each of said exterior wall panels further including first and second interconnection members having a length and depending from said interior facing surface, said interconnection members further having free end portions, respectively, said interconnection members for interconnecting adjacent exterior wall panels and providing a support surface parallel to said interior facing surface for supporting and securing said wall partitions in spaced relation to said interior facing surface.

12. A building as defined in claim 11, further including one of said interconnection members being mated, abutting relationship with another of said interconnection members of an adjacent exterior wall panel whereby said mated wall panels are adjoined to one another; and means for rigidly securing one of said exterior walls to said adjacent exterior wall, said means for rigidly securing being disposed in said interconnection members.

13. A building as defined in claim 12 wherein said means for rigidly securing being disposed in said first and second interconnection members includes a first plurality of holes spaced along said length of said first interconnection member and a second plurality of holes spaced along said length of said second interconnection member, said first and second plurality of holes being aligned with each other; and rivets disposed through said aligned holes in said first and second interconnection members of said adjacent wall panels for rigidly securing together said adjacent wall panels.

14. A building as defined in claim 13 wherein said rigidly secured, mated first and second interconnection members of said adjacent exterior wall panels provide a rigid support surface for supporting and securing said wall partitions.

15. A building as defined in claim 14 wherein said corner wall columns further having a length, said columns include first and second terminal ends extending said length of said columns, said first terminal end being mated in abutting relationship with said second interconnection member of one of said adjacent exterior wall panels and said second terminal end being mated in abutting relationship with said first interconnection member of another said adjacent exterior wall panel.

16. A building as defined in claim 15 further including means disposed in said first and second terminal ends including a first plurality of holes spaced along said length of said first terminal end and a second plurality of holes spaced along said length of said second terminal end, said first and second plurality of holes in said first and second terminal ends, respectively, being aligned with said first and second plurality of holes spaced along said length of said first and second interconnection members, respectively; and rivets disposed through said aligned holes in said first terminal end and said second interconnection member, said rivets further disposed in said aligned holes of said second terminal end and said first interconnection member whereby said columns are rigidly secured to said adjacent wall panels.

17. A building as defined in claim 16 wherein said mated first terminal end and second interconnection member and said mated second terminal end and first interconnection member provide rigid support surfaces for supporting and securing said wall partitions.

18. A building as defined in claim 15 wherein each of said columns includes an elongated support member having a plurality of elongated, integral elements with a W-shaped cross sectional configuration, two of said integral elements being support elements which are disposed at a right angle to each other to provide support surfaces for supporting and securing said wall partitions.

19. A building as defined in claim 1 wherein solid rivets secure said roof beams and said side pitch panels to said columns, and said rivets secure said exterior wall panels to said platform, to each other and to said columns whereby a desired force secures aid boxlike structure together.

20. A building as defined in claim 1 wherein said exterior wall panels are constructed of steel having an external and internal surface, said external surface having a coating of aliphatic polyurethane to prevent corrosion.

21. A building as defined in claim 20 wherein said exterior wall panels are constructed of 16 gauge steel.

22. A building as defined in claim 1 wherein each of said gypsum type board sheets has top, bottom, first and second side edges, said gypsum boards being stacked on each other so that said top, first and second side edges of sheets overlap joints formed by abutted stacked sheets, said joints being overlapped.

23. A building as defined in claim 1 wherein said interior pitch panels each provide a support surface for supporting and securing said ceiling partitions.

24. A building as defined in claim 1 wherein said exterior roof panels are supported and attached to said outer and said inner pitch panels to define the external roof of said building.

25. A building as defined in claim 1 further including a sump disposed within said support platform for collecting spillage stored in said modular building.

26. A building as defined in claim 25 further including a floor spaced above said sump adapted for supporting material stored in said building.

27. A roof panel for a fire resistant building, comprising:

a plurality of spaced pitch panels each having inner and outer facing surfaces;

an exterior roof panel secured to and supported on said outer facing surfaces of said pitch panels;

a ceiling partition secured to said pitch panels, comprising a plurality of stacked ceiling partition comprising sheets of gypsum type boards secured to said inner facing surfaces of said pitch panels; and a metal sheet having a plurality of outside edges stacked against a surface of said stacked sheets of gypsum type board the edges of said metal sheet overlaps the edges of an adjacent said metal sheet to form an interior surface of said roof panel.

28. A roof panel as defined in claim 27 wherein said plurality of gypsum type board sheets comprise three or more stacked sheets.

29. A roof panel as defined in claim 28 wherein each sheet of said gypsum board and said metal sheet are individually attached to said inner facing surfaces of said pitch panels.

30. A roof panel as defined in claim 27 wherein each of said sheets of gypsum type board comprise $\frac{5}{8}$ inch thick type X, fire-rated gypsum board.

31. A roof panel as defined in claim 30 wherein each of said sheets of gypsum type board and said metal sheet are individually attached to said exterior wall panel.

32. A roof panel as defined in claim 27 further including a chemical resistant coating on said interior facing surface of said metal sheet.

33. A roof panel as defined in claim 27 wherein said exterior roof panel is constructed of 16 gauge steel.

34. A roof panel as defined in claim 27 wherein said exterior wall panels are constructed of steel having an external and internal surface, said external surface having a coating of aliphatic polyurethane to prevent corrosion.

* * * * *